US006311341B1

(12) United States Patent
Zwezdaryk

(10) Patent No.: US 6,311,341 B1
(45) Date of Patent: Nov. 6, 2001

(54) TOILET COVER

(76) Inventor: Shane Zwezdaryk, 46 Hyde Avenue, Apt. #2, Toronto, Ontario (CA), M6M 1J4

( * ) Notice: Subject to any disclaimer, the term of this patent is extended or adjusted under 35 U.S.C. 154(b) by 0 days.

(21) Appl. No.: 09/630,733

(22) Filed: Aug. 2, 2000

(51) Int. Cl.[7] ..... A47C 23/02
(52) U.S. Cl. ..... 4/254; 4/661; 4/246.1
(58) Field of Search ..... 4/254, 661, 253, 4/246.1, 667, 476, 477, 478; 397/188.1, 188.13, 188.14; 312/235.5, 228, 239.2

(56) References Cited

U.S. PATENT DOCUMENTS

| | | | | |
|---|---|---|---|---|
| D. 243,088 | * | 1/1977 | Halvorsen | D23/71 |
| D. 331,621 | * | 12/1992 | Tapolcai | D23/214 |
| 799,418 | * | 9/1905 | Thompson et al. | 4/300 |
| 2,155,548 | * | 4/1939 | Hompesch | 4/246.3 |
| 2,658,201 | * | 11/1953 | Sherwood | 4/661 |
| 2,749,968 | * | 6/1956 | Suser | 4/661 |
| 3,566,414 | * | 3/1971 | Basner | 4/661 |
| 4,160,295 | * | 7/1979 | Putyra | 4/420 |
| 4,307,923 | * | 12/1981 | Raz | 312/237 |
| 4,368,551 | * | 1/1983 | Cummings | 4/661 |
| 5,487,192 | * | 1/1996 | Hodges | 4/246.3 |
| 5,488,743 | * | 2/1996 | Alfonso | 4/246.1 |

* cited by examiner

*Primary Examiner*—Gregory L. Huson
*Assistant Examiner*—Huyen Le
(74) *Attorney, Agent, or Firm*—Gowling LaFleur Henderson LLP

(57) ABSTRACT

In one of its' aspects, the invention provides a chair for covering a bathroom toilet with a tank, a hinged seat, a bowl, and a flushing handle. The chair has a tank cover for covering the tank of the toilet, and a bowl cover connected to the tank cover for covering the hinged seat and the bowl of the toilet. The bowl cover has a hinged seat cover and a front portion. The front portion has a protrusion for receiving the front part of the bowl of the toilet to allow the front part of the bowl to extend outwardly beyond a remainder of the front portion. The chair also has a pair of arm rests coupled with the tank cover, each arm rest having a front portion and a back portion. The arm rests are undercut to create a space between the bowl cover and the front portion of the arm rests to admit a user's thighs. The claim further has first and second pedal assemblies operably connected to the hinged seat cover and the hinged seat cover and hinged seat from the closed to the opened positions.

8 Claims, 7 Drawing Sheets

TOILET COVER

FIELD OF THE INVENTION

The present invention relates to a toilet cover. In particular, the present invention relates to a chair for covering a standard bathroom toilet.

BACKGROUND OF THE INVENTION

There are many shortcomings to the standard bathroom toilet. Toilets are generally made of porcelain and are not particularly aesthetically pleasing. Also, a standard toilet has a lid that a person must bend forward to lift prior to using the toilet. This can be difficult for people suffering from back pain and can be non-hygienic. Further, it may be difficult for a person to stabilize themselves or to lower themselves from a standing position to a seated position on a standard toilet or to raise themselves from a seated position to a standing position.

Chairs for covering a standard bathroom toilet are disclosed in U.S. Pat. No. 3,905,051 to Gozdziewski and U.S. Pat. No. 3,716,872 to Zieman.

In U.S. Pat. No. 3,905,051 (Godziewski) discloses a toilet seat chair that can be fixed to a standard toilet with a seat cover removed. The toilet seat chair has two integral sides and is placed over a toilet bowl and secured into place. A pair of spaced apart arm rests are undivided from the sides, along the entire length of the arms, and can be used for stability and to help a user when seating or raising his or herself. A seat of the chair is positioned over the toilet bowl and is hingedly attached such that it can be manually raised when the toilet seat is not in use and can be lowered to provide a seating surface.

This chair provides a cover for toilet bowl but does hot cover the tank therefore only partially masking the toilet. Also, the shape of the chair has a flat front which makes it more awkward for a person to position their legs to stand over the bowl of the toilet when using it and to comfortably part their legs when seated on the toilet seat chair. Further, the seat must be raised by hand which requires touching the seat and may require a person to bend over to raise the toilet seat.

In U.S. Pat. No. 3,716,872 (Zieman) discloses a toilet chair that fits over a toilet and covers both a toilet bowl and toilet tank. Two sides of the chair are provided and two arms integral with the two sides along the entire length of the arms. A seating area between the two arms is located above the toilet bowl and a pair of hinged doors provide a cover that can be opened to use the toilet or closed when the toilet is not in use. The toilet chair hides both the toilet bowl and the tank to provide an arm-chair like appearance and the arms can provide support for those who require it.

Like Godziewski, the Zieman chair presents a flat front which makes it somewhat awkward or difficult for a person to position their legs to stand over the bowl of the toilet when using it. Similarly, the arm rests do not enable the person to comfortably part their legs when seated on the toilet chair. Further, the cover must also be opened by hand which may require a person to bend over to raise and lower the toilet seat and requires touching the seat.

It is therefore among the objects of the present invention to provide a chair for covering a standard bathroom toilet, allowing a person to position their legs to stand over the bowl of the toilet, to comfortably part ones legs when seated on the toilet and to allow a person to raise a toilet cover or seat without bending over or touching the cover or seat.

SUMMARY OF THE INVENTION

In one of its' aspects, the invention provides a chair for covering a bathroom toilet with a tank, a hinged seat, a bowl, and a flush mechanism. The chair has a tank cover for covering the tank of the toilet, and a bowl cover connected to the tank cover for covering the hinged seat and the bowl of the toilet. The bowl cover has a hinged seat cover and a front portion. The front portion has a protrusion for receiving the front part of the bowl of the toilet to allow the front part of the bowl to extend outwardly beyond a remainder of the front portion. The chair further has a flush actuation means associated with the flush mechanism to allow a user to flush the toilet.

In another aspect, there is provided a chair for covering a bathroom toilet with a tank, a hinged seat, a bowl, and a flush mechanism. The chair has a tank cover for covering the tank of the toilet, a bowl cover with a hinged seat cover, the bowl cover being connected to the tank cover for covering the hinged seat and the bowl of the toilet, and a pair of arm rests connected to the rear portions, each arm rest having a front portion and a back portion. The arm rests are undercut so as to create a space between the bowl cover and the front portion of the arm rests. The chair further has a flush actuation means associated with the flush mechanism to allow a user to flush the toilet.

In another aspect, the invention provides a chair for covering a bathroom toilet with a tank, a bowl, a hinged seat for hinged movement between an open and a closed position and a flush mechanism. The chair has a tank cover for covering the tank of the toilet, a bowl cover connected to the tank cover for covering the hinged seat and the bowl of the toilet. The bowl cover has a hinged seat cover for hinged movement between an opened and a closed position. The chair also has a pedal assembly for cooperating with the hinged seat cover to move the hinged seat cover from the closed position to the opened position by operating the pedal assembly. The chair further has a flush actuation means associated with the flush mechanism to allow a user to flush the toilet.

In another of its' aspects, the invention provides a chair for covering the bathroom toilet with a tank, a bowl, a hinged seat for hinged movement between an opened and a closed position and a flush mechanism. The chair has a tank cover for covering the tank on the bathroom toilet, a bowl cover connected to the tank cover for covering the hinged seat and the bowl of the toilet. The bowl cover has a front portion and a hinged seat cover for hinged movement between an opened and closed position. The front portion has a protrusion for receiving a front part of the bowl of the toilet to allow the front part of the bowl to extend outwardly beyond the remainder of the front portion. The chair also has a pair of arm rests connected to the tank cover, each arm rest has a front portion and a back portion and is undercut so as to create a space between the bowl cover and the front portion of the arm rests, and a pedal assembly for cooperating with the hinged seat cover for moving the hinged seat cover from the closed position to the opened position by operating the pedal assembly. The chair further has a flush actuation means associated with the flush mechanism to allow a user to flush the toilet.

BRIEF DESCRIPTION OF THE DRAWINGS

The invention will be better understood with reference to the drawings in which.

DETAILED DESCRIPTION OF THE INVENTION

Figure 1:
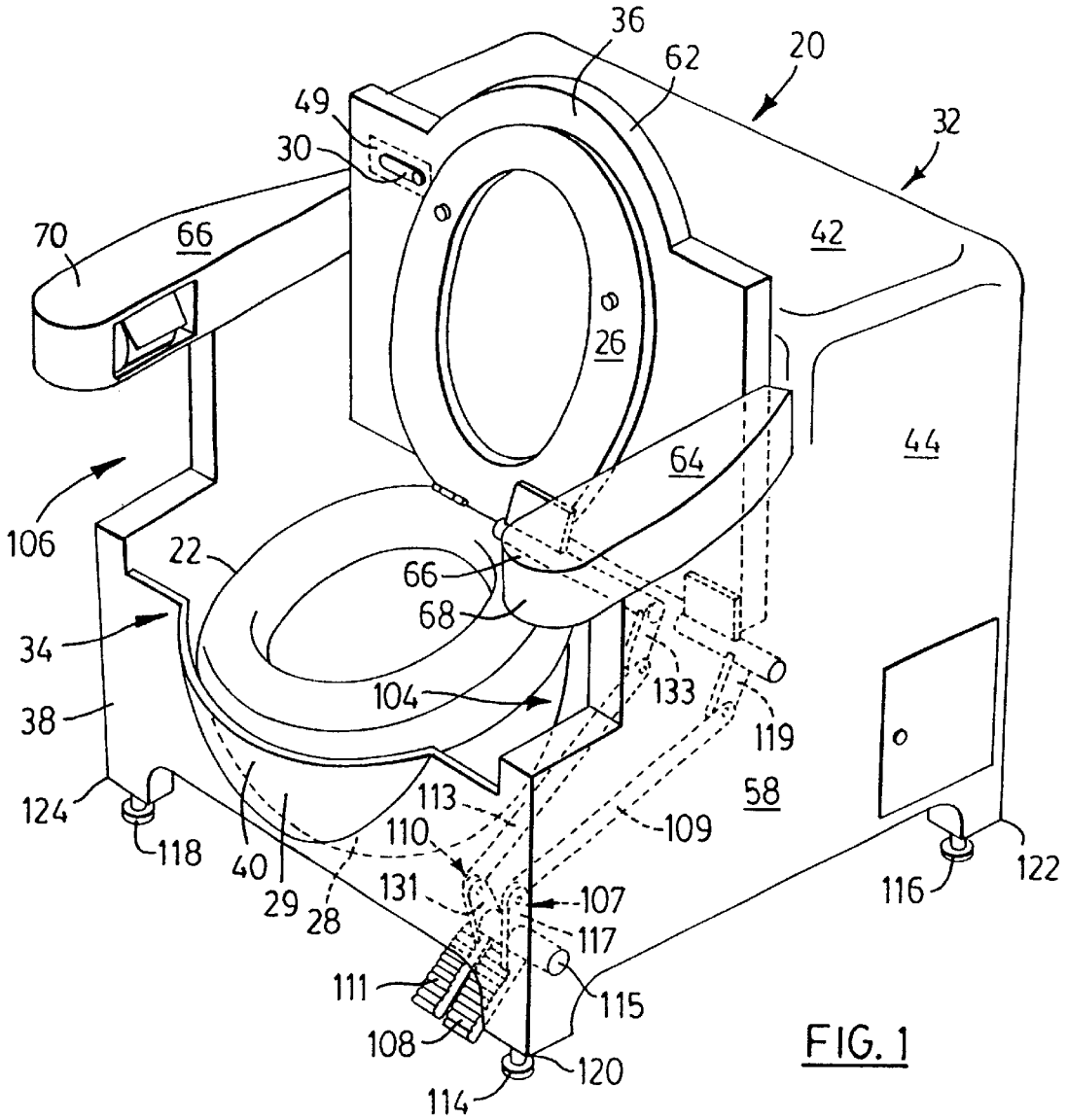
FIG. 1 is an isometric view illustrating a preferred embodiment of a chair according to the invention.
Figure 2:
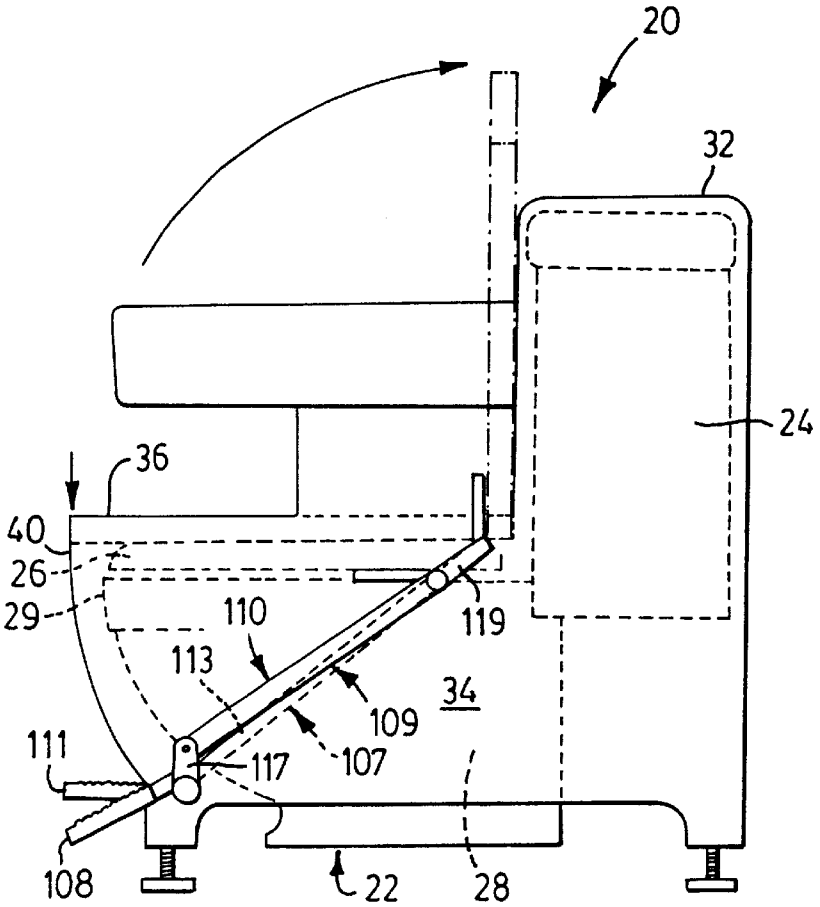
FIG. 2 is a side view of the chair of FIG. 1 with a hinged seat cover in a closed position and showing the hinged seat cover in an opened position in ghost outline.

Reference is first made to FIGS. 1 and 2 which illustrate a preferred embodiment of a chair for covering a bathroom toilet according to the invention and indicated generally by the numeral 20. A bathroom toilet 22 generally has a tank 24, a hinged seat 26, a bowl 28 with a front part 29 and a flushing handle 30. The chair 20 includes a tank cover 32 for covering the tank 24 of the toilet 22 and a bowl cover 34, coupled with the tank cover 32 for covering the hinged seat 26 and the bowl 28 of the toilet 22. The bowl cover 34 has a hinged seat cover 36 and a front 38 with a protrusion 40 for receiving the front part 29 of the bowl 28 to allow the front part 29 of the bowl 28 to extend outwardly beyond a remainder of the front 38 of the bowl cover 34.

Figure 3:
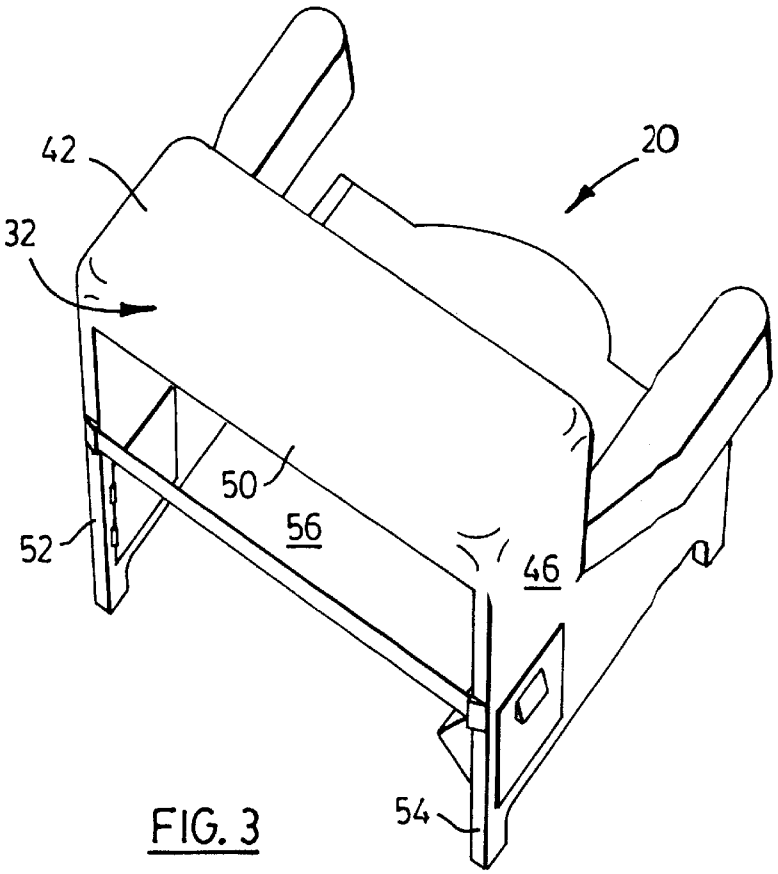
FIG. 3 is an isometric view of the chair of FIG. 1 showing the toilet chair from above and behind.

Referring first to the tank cover 32 as seen in FIGS. 1 and 3, the tank cover 32 is substantially cuboid with a rectangular top 42 and substantially rectangular first and second side portions 44, 46, projecting perpendicularly downwardly from rectangular top 42. A front face 48 also projects perpendicularly downwardly from the top 42 and extends between the first and second side portions 44, 46. An aperture 49 in the front face 48 allows a user to access the flushing handle 30, for flushing the toilet 22. A top lip 50, opposes the front face 48, projecting downwardly from the top 42 and extending between first and second side portions 44, 46. First and second side lips 52, 54, oppose the front face 48 and extend perpendicularly inwardly from the first and second side portions 44, 46 respectively. An opening 56 is defined by the top lip 50 and first and second side lips 52, 54. The back portion 32 is sized and shaped to slide over the tank 24 of the standard toilet 22.

Figure 4A:
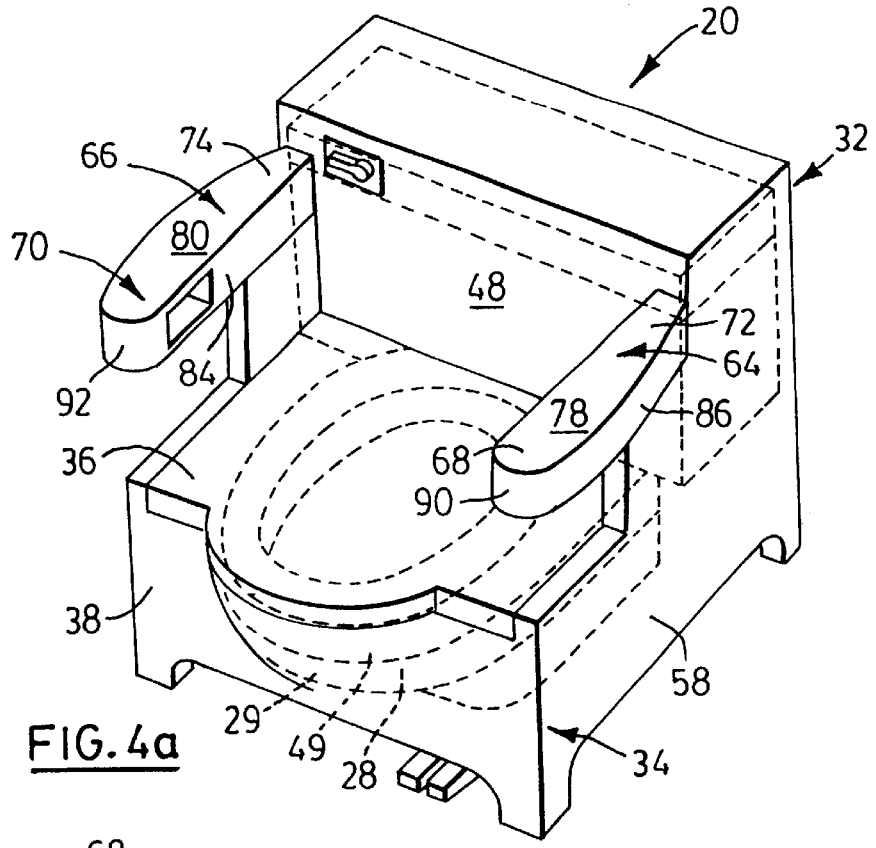
FIG. 4*a* is an isometric view of the chair of FIG. 1, showing a toilet in hidden detail.
Figure 4B:
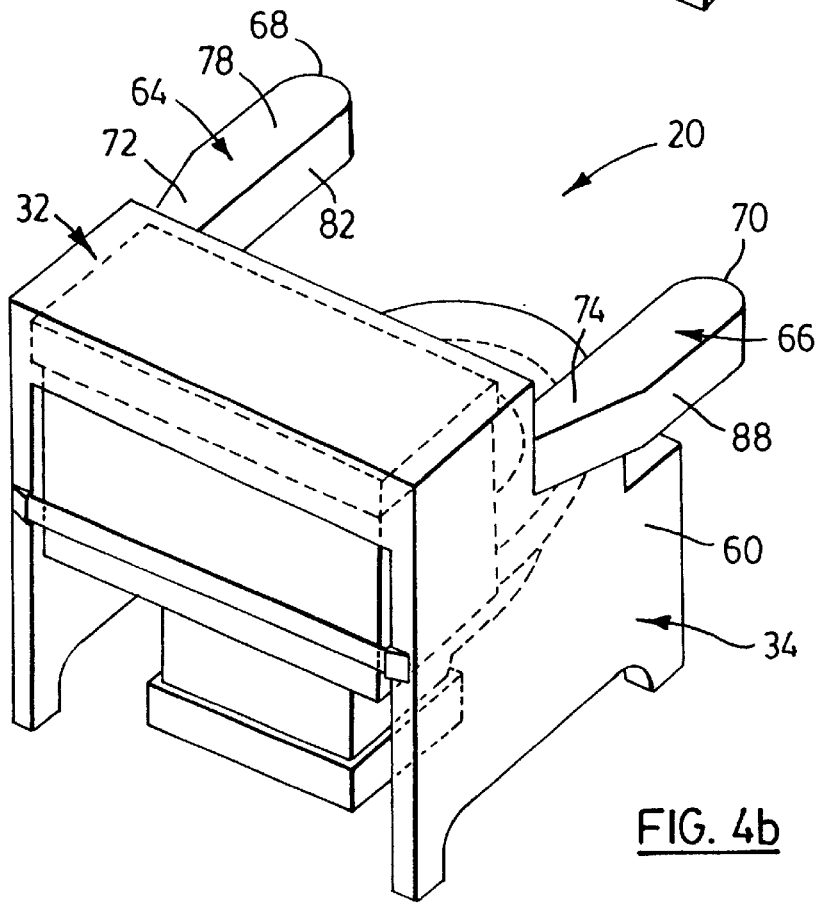
FIG. 4*b* is an isometric view of the chair of FIG. 3, showing a toilet in hidden detail and full outline, when appropriate.

Now referring to the bowl cover 34, best shown in FIGS. 1, 4*a* and 4*b*, the bowl cover 34 is integral with the tank cover 32 and extends outwardly therefrom. The bowl cover 34 includes the front 38, the hinged seat 36, and first and second opposing bowl cover side portions 58, 60. The front portion 38 includes the protrusion 40 that projects outwardly from the remainder of the front portion 38 to closely contour around the front part 29 of the bowl 28 of the toilet 22. The first bowl cover side portion 58 is integral with the first side portion 44 of the tank cover 32. Similarly, the second bowl cover side portion 60 is integral with the second side portion 46 of the tank cover 32.

The hinged seat cover 36 is substantially rectangular with a protruding parabolic segment 62 for covering the front part 29 of the bowl 28. Two hinges 62, shown in FIG. 6, attach the hinged seat cover 36 to the tank cover 32 such that the hinged seat cover is moveable between an opened position shown in FIG. 1 and a closed position shown ghost outline in FIG. 2.

Referring to FIGS. 4*a* and 4*b*, two arm rests 64, 66 are fixed to the front face 48 of the tank cover 32 and extend substantially perpendicularly therefrom. Each arm rest 64,66 has a front portion 68,70, respectively, and a rear portion 72,74, respectively. Each of arm rests 64, 66 is defined by an arm rest cover 78,80, respectively, an inner arm rest side 82,84, respectively, and an outer arm rest side 86,88, respectively. Each front portion 68,70 includes a curved arm rest front 90,92, respectively. Side portions 58,60 extend downwardly from the rear portions 74,76, respectively of arm rests 64,66, respectively.

Figure 5:
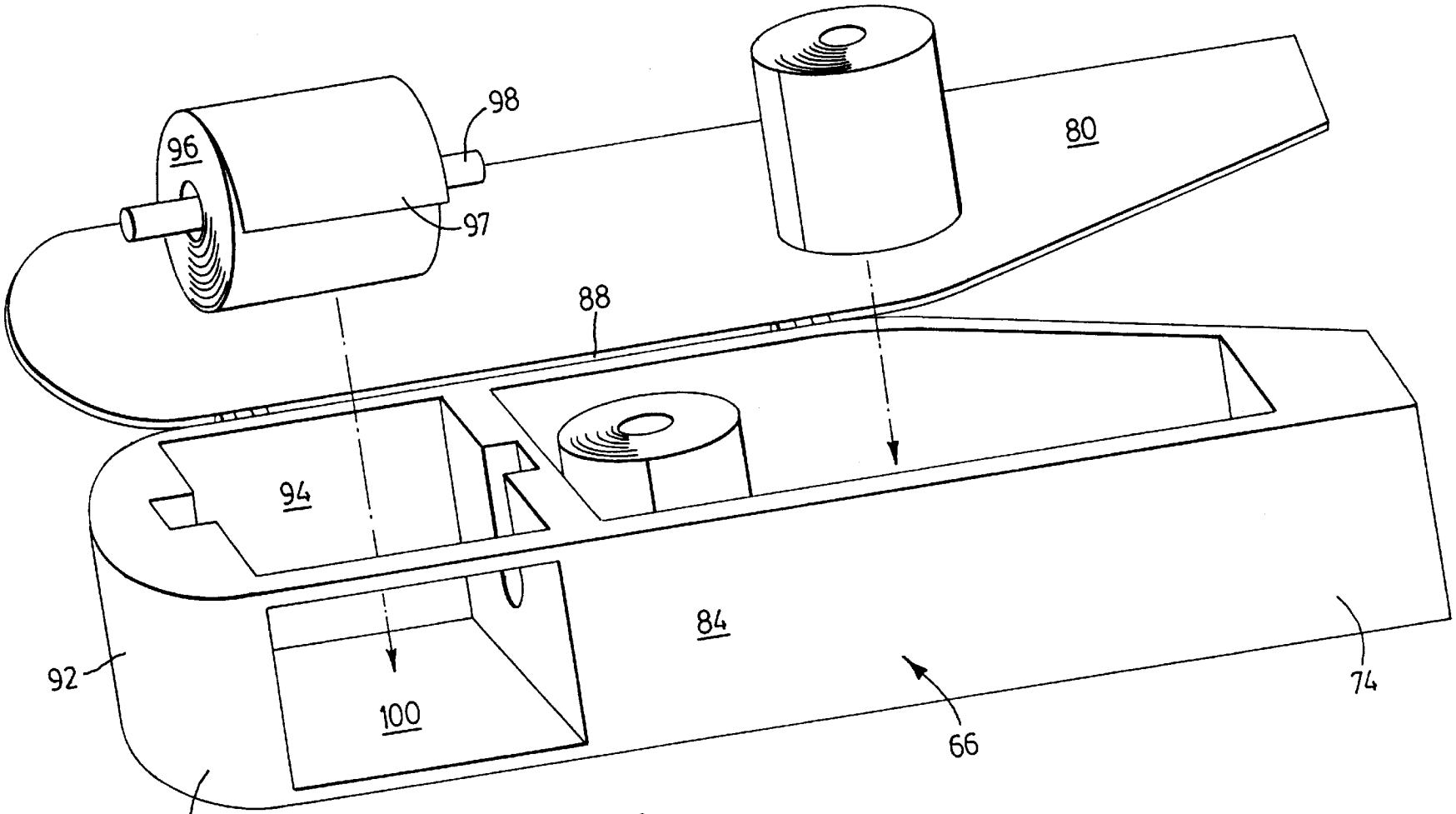
FIG. 5 is an isometric partial view of an arm of the chair of FIG. 1, showing an arm cover in an opened position and drawn to a larger scale.

Referring now to FIG. 5, the arm rest cover 80 of arm rest 66 is hingedly attached to outer arm rest side 88. The arm rest cover 80 is moveable between a closed position shown in FIG. 1 and an opened position. A toilet paper dispensing compartment 94 at the front portion 70 in arm rest 64 is appropriately sized and shaped to hold a roll 96 of toilet paper 97 on a retaining peg 98. The dispensing compartment 94 is accessible by placing the arm rest cover 80 in the open position for insertion of the roll 96 of toilet paper 97. An opening 100 in inner arm rest side 84 is sized and shaped to allow the toilet paper 97 to be dispensed therethrough. A storage compartment 102 in rear portion 74 of arm rest 66 provides storage for additional toilet paper rolls or other suitably sized items.

Similarly, the arm rest cover 78 is hingedly attached to the outer arm rest side 86 and has an opened and closed position. A large storage compartment 106 in the arm rest 64 is accessible by placing the arm rest cover 78 in the opened position. The large storage compartment 106 can be used for storage of any suitably sized item(s).

Referring now to FIG. 1, the arm rests 64,66 are undercut such that there is a space 104,106 respectively, between front portions 68,70 and seat side portions 58,60. The space 104,106 allows a user to comfortably part their legs when seated on the bathroom toilet 22 or on the toilet chair 20. The thighs of a user can therefore be admitted by the space 104,106.

Figure 6:
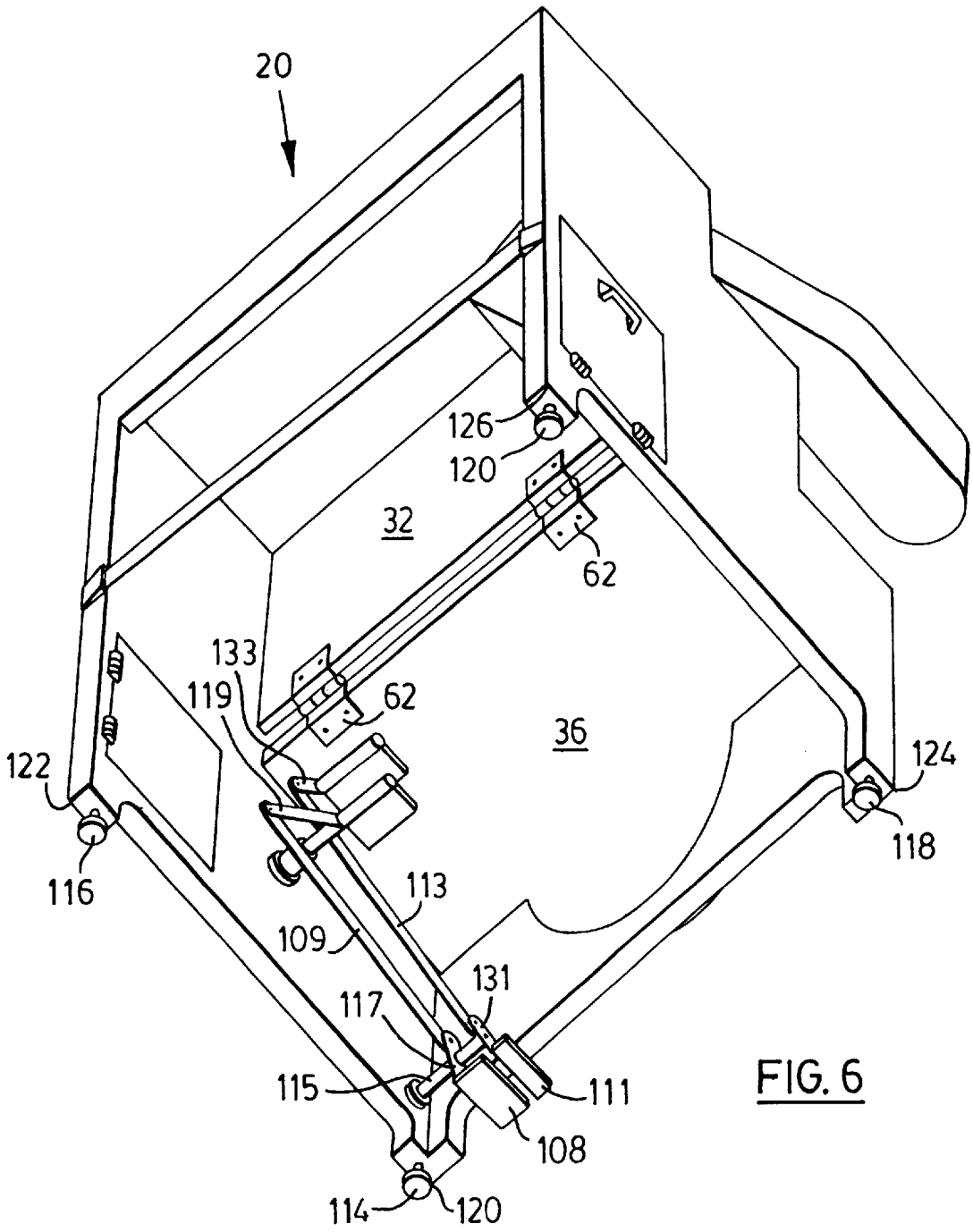
FIG. 6 is a perspective view of the chair of FIG. 1 showing the toilet chair from its' underside.

Referring now to FIGS. 1, 2 and 6, the toilet chair 20 has a first pedal assembly 107 that protrudes from the front 38 proximal the first opposing seat side portion 58 and includes a first pedal 108 and a linkage rod 109 extending between the pedal 10 and the hinged seat cover 36. The fist pedal 108 and linkage rod 109 are operably coupled to the hinged seat cover 36 such that when the hinged scat cover 36 is in the closed position and a user depresses the first pedal 108, the hinged scat cover moves from the closed position to the opened position.

The first pedal 108 is pivotally mounted by a pivot pin 115 and has a first lever 117 radially extending therefrom to rotate as the first pedal 108 is depressed. The linkage rod 109 extends from the first lever 117 to a second lever 119 secured to the hinged seat cover 36. Accordingly, depressing the pedal 108 will cause the first lever 117 to pull the linkage rod 109 and in turn the second lever 119 to cause opening of the hinged seat cover 36. The toilet chair 20 also has a second pedal assembly 110 located beside the first pedal assembly 107. The second pedal assembly 110 includes a second pedal 111 and second linkage rod 113, the second pedal 111 and second linkage rod 113 are operably connected to the hinged seat 26 such that when the hinged seat 26 is in the closed position and a user depresses the second pedal 111 the hinged scat 26 moves from the closed position to the opened position.

The second pedal assembly 110 may operate in much the same way as the first pedal assembly and may include a pedal lever 131 extending from and rotatable with the second pedal 111. The pedal lever is connected by the second linkage rod 113 to a seat lever 133 secured to the hinged scat 26. Depressing the second pedal 111 causes the pedal lover 131 to rotate in turn pulling the second linkage rod 113 to pull the seat lever 133 to rotate the hinged seat 26 about its hinge into the open position.

In use, the toilet chair 20 is located to cover a bathroom toilet. There are four legs 112, 114,116,118 extending downwardly from comers 120,122,124,126 respectively of the chair 20. Each of the four legs 112,114,116,118 can be adjusted for stability when the chair 20 is in place. The toilet chair 20 therefore provides a cover for the bowl 28 and the tank 24 of the toilet 22. The protrusion 40 in the front 38 can allow a person to position their legs to stand over the bowl of the toilet when using the toilet. The toilet chair 20 can also allow a user to comfortably part their legs when seated thereon. The first and second pedals 108, 111 respectively can allow a user to move the hinged seat cover 36 and the hinged seat 26 from the closed position to the opened position by depressing each pedal 108,111. The first and second arm rests 64,68, respectively, can allow a person to stabilize themselves when lowering themselves from a standing position to a seated position or when raising themselves from a seated position to a standing position.

Figure 7A:
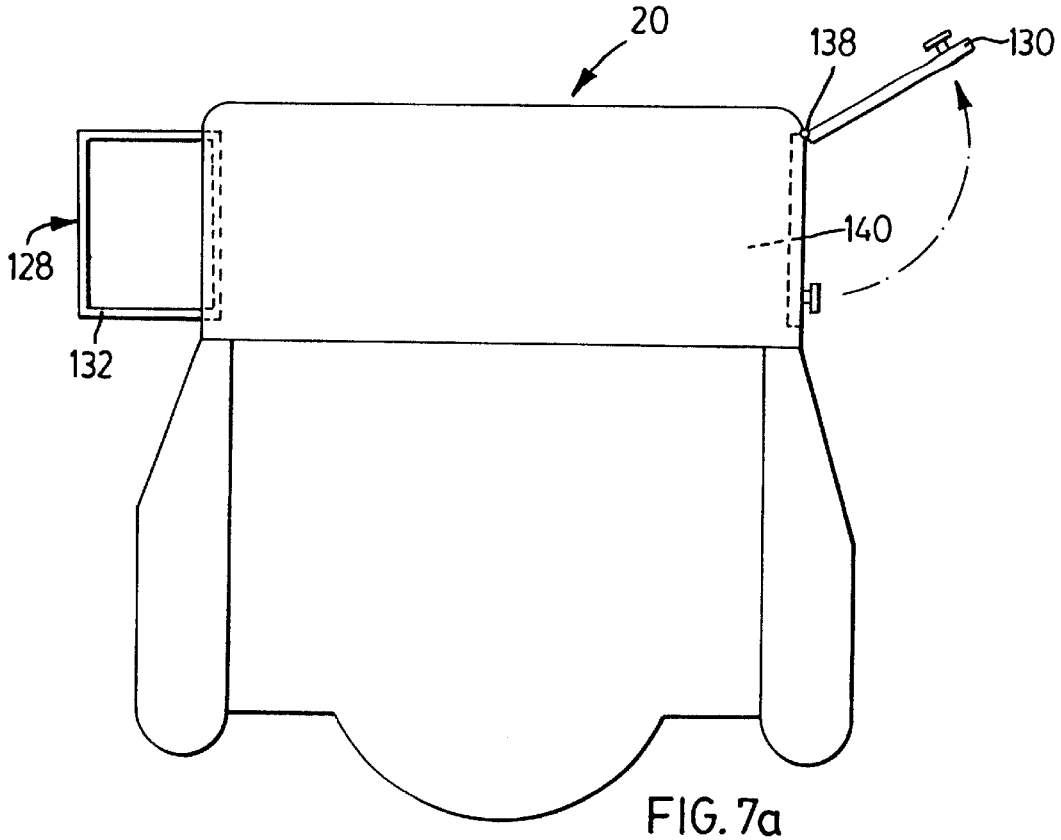
FIG. 7*a* is a top view of an alternate embodiment of a chair according to the invention showing it fitted with a garbage can and a magazine holder.
Figure 7B:
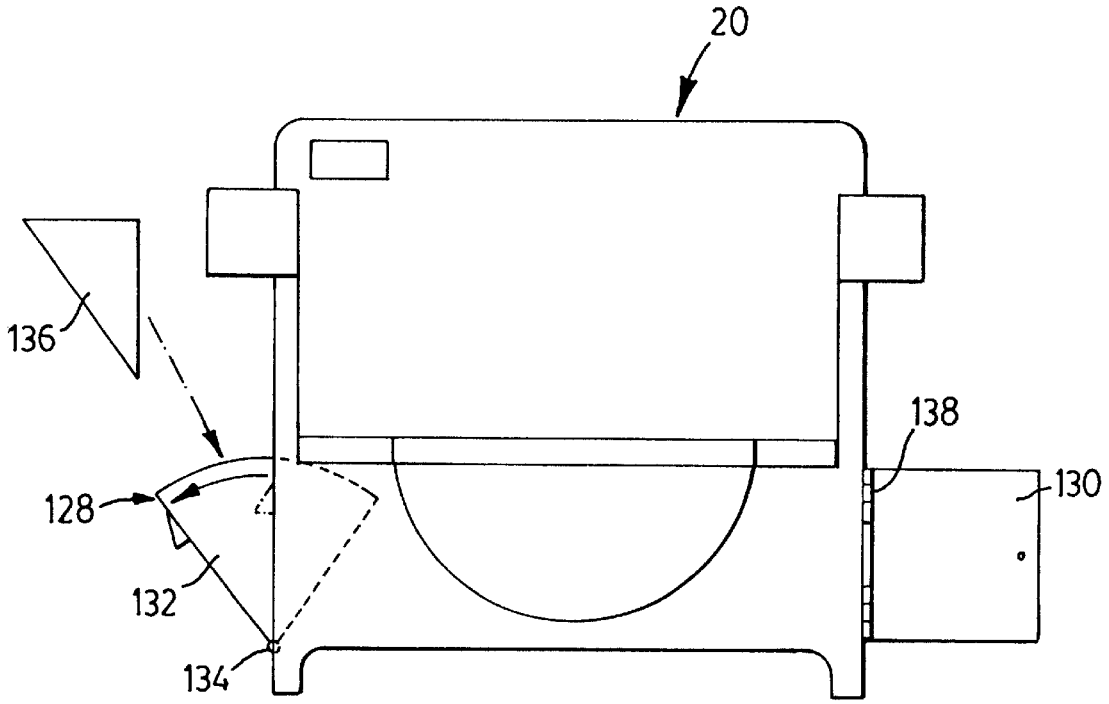
FIG. 7*b* is a front view of the chair of FIG. 7*a;*

It will be evident that chairs for covering a toilet according to the invention can take forms other than that shown in the drawings. For instance, the chair 20 can include a garbage container 128 or a storage area door 130 as shown in FIGS. 7*a* and 7*b*. A receptacle holder 132 is hingedly attached along a lower edge 134 such that a top portion can be opened outwardly. A receptacle 136 is removably receivable in the receptacle holder 132 to allow a user to easily remove for ease of emptying or washing.

The storage area door 130 is hingedly attached along a side 138 and is movable between opened and closed positions. In the opened position, the storage area door 130 allows access to a storage area 140 that can be used for storage of various items such as magazines, books or cleaning products.

Figure 10:
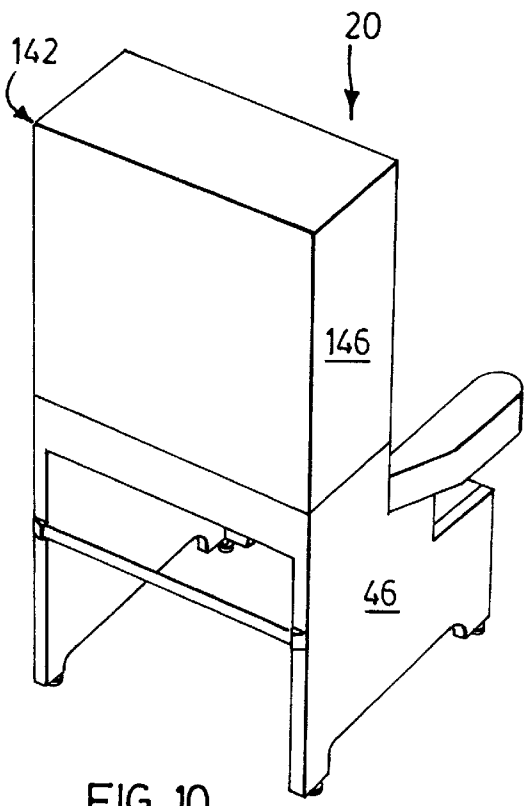
FIG. 10 is a perspective view of the chair of FIG. 9 showing the back of the toilet chair.
Figure 9:
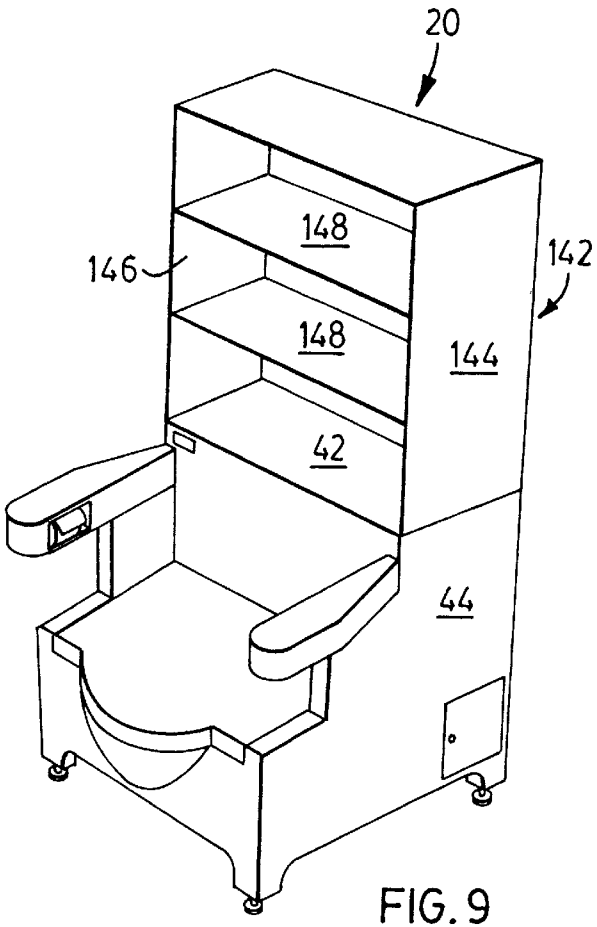
FIG. 9 is an isometric view of another embodiment of a chair according to the invention showing it fitted with a shelf component.

As seen in FIGS. 9 and 10, the chair 20 can also include a shelf component 142 fixed to the top 42 of the tank cover 32. The sides 144, 146 of this shelf component 142 are substantially coplanar with and extend upwardly from the first and second side portions 44, 46, respectively. It will be evident that each shelf 148 extends between the sides 144, 146 of this shelf component 142. Also, there can be any number of shelves extending between the sides 144,146, operable for storage or use as a medicine cabinet. Thus, the height of each shelf 148 can be adjustable or can be fixed. Additionally, doors can be hingedly attached to the shelf component 142 to provide a substantially enclosed cabinet.

Figure 8:
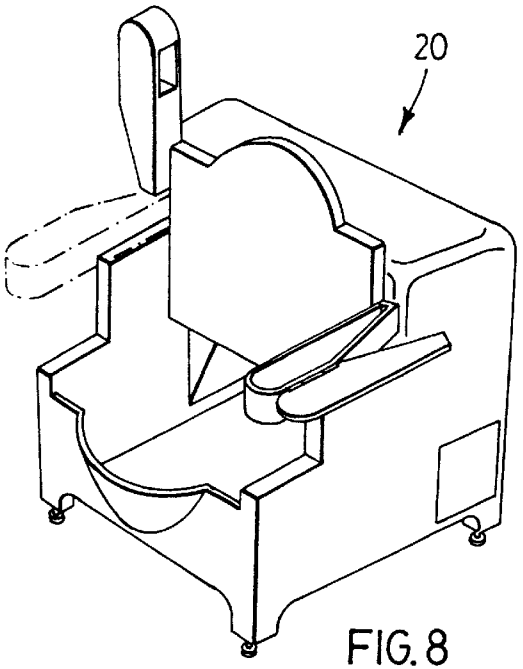
FIG. 8 is an isometric view of another embodiment of a chair according to the invention, showing it fitted with a hinged arm rest.

The first and second pedal assemblies can be any assembly, such as pneumatic or electrical device, operable for opening the hinged seat and the hinged seat cover. Similarly, the chair can include provisions for closing the hinged seat and hinged seat cover. Also, an additional pedal assembly can be provided to flush the toilet rather than having an aperture to access the flushing handle of the toilet. Further, an ashtray can be included in one of the arm rests. The arm rests can be hingedly attached to the tank cover such that they can be moved upwardly, as shown in FIG. 8. The bowl cover can be coupled with the tank cover and does not need to be integral. The four legs do not all need to be adjustable. Also, the size and shape of any of the features of the cover can vary while still performing the same function.

I claim:

1. A chair for covering a bathroom toilet with a tank, a bowl, a hinged seat for hinged movement between an opened and a closed position, and a flush mechanism, the chair comprising;

a tank cover for covering the tank of the toilet;

a bowl cover connected to the tank cover, for covering the hinged seat and the bowl of the toilet, the bowl cover having a hinged seat cover for hinged movement between an opened and a closed position;

a first pedal assembly operably connected to the hinged seat cover to move the hinged seat cover from the closed position to the opened position by operating the pedal assembly; said pedal assembly including a first pedal pivotably attached to said chair, a first lever arm rigidly attached to said first pedal for rotation therewith, a second lever arm rigidly secured to said seat cover for movement of said seat and a linkage rod operably connecting said first and second lever arms; and, means for accessing said flush mechanism to allow a user to flush the toilet.

2. A chair for covering a bathroom toilet as claimed in claim 1, wherein the chair further comprises a second pedal assembly operably connected to the hinged seat of the toilet such tat a user can move the hinged seat from a seating position to an opened position by operating the second pedal assembly; said second pedal assembly having a second pedal pivotably connected to said chair, a pedal lever extending from and rotatable with said second pedal, a seat lever securable to said hinged seat form movement of said hinged seat about a hinge thereof and a second linkage rod operably connecting said pedal lever with said seat lever.

3. A chair for covering a bathroom toilet as claimed in claim 2, wherein the chair further comprises a shelf component extending from a top of the tank cover.

4. A chair for covering a bathroom toilet as claimed in claim 1, wherein the chair further comprises a shelf component extending from a top of the tank cover.

5. A chair for covering a bathroom toilet with a tank a bowl, a hinged seat for hinged movement between an opened and a closed position, and a flush mechanism, the chair comprising;

a tank cover for covering the tank on the standard bathroom toilet;

a bowl cover connected to the tank covet for covering the hinged seat and the bowl of the standard toilet, the bowl cover having a front portion and a hinged seat cover for hinged movement between an opened and a closed position, the front portion having a protrusion for receiving a front part of the bowl of the toilet to allow the front part of the bowl to extend outwardly beyond a remainder of the front portion;

a pair of arm rests, coupled with the tank cover, each arm rest having a front portion and a back portion, the arm rests being undercut so as to create a space between the bowl cover and the front portion of the arm rests to admit a user's thighs; and a first pedal assembly operably connected to the hinged seat cover to move the hinged seat cover from the closed position to the opened position by operating the pedal assembly; said pedal assembly including a first pedal pivotably attached to said chair, a first lever aim rigidly attached to said first pedal for rotation therewith, a second lever arm rigidly secured to said seat cover for movement of said seat and a linkage rod operably connecting said means for accessing said flush mechanism to allow a user to flush the toilet.

6. A chair for covering a bathroom toilet as claimed in claim 5, wherein the chair further comprises a second pedal assembly for cooperating with the linked seat of the toilet such that a user can move the hinged seat from a seating position to an opened position by operating the second pedal assembly, said second pedal assembly having a second pedal pivotably connected to said chair, a pedal lever extending from and rotatable with said second pedal, a seat cover securable to said hinged seat for movement of said hinged seat about a hinge thereof and a second linkage rod operably connecting said pedal lever with said seat lever.

7. A chair for covering a bathroom toilet as claimed in claim 6, wherein the chair further comprises a shelf component extending from a top of the tank cover.

8. A chair for covering a bathroom toilet as claimed in claim 5, wherein the chair further comprises a shelf component extending from a top of the tank cover.

* * * * *